US007082886B2

(12) United States Patent
Noguchi et al.

(10) Patent No.: US 7,082,886 B2
(45) Date of Patent: Aug. 1, 2006

(54) SEWING MACHINE

(75) Inventors: Yasukaza Noguchi, Nagoya (JP); Yasuhiko Kawaguchi, Nagoya (JP); Masato Kato, Kasugai (JP)

(73) Assignee: Brother Kogyo Kabushiki Kaisha, Nogoya (JP)

( * ) Notice: Subject to any disclaimer, the term of this patent is extended or adjusted under 35 U.S.C. 154(b) by 0 days.

(21) Appl. No.: 11/150,217

(22) Filed: Jun. 13, 2005

(65) Prior Publication Data

US 2005/0223957 A1 Oct. 13, 2005

Related U.S. Application Data

(63) Continuation of application No. 10/757,448, filed on Jan. 15, 2004, now Pat. No. 6,941,881.

(30) Foreign Application Priority Data

Jan. 22, 2003 (JP) ..... 2003-013343

(51) Int. Cl.
*D05B 65/00* (2006.01)

(52) U.S. Cl. ..... 112/286; 112/224

(58) Field of Classification Search ..... 112/470.01, 112/224, 225, 236, 286, 302, 253; 223/99
See application file for complete search history.

(56) References Cited

U.S. PATENT DOCUMENTS

| | | | | |
|---|---|---|---|---|
| 3,250,447 | A | 5/1966 | Larew | |
| 3,893,602 | A * | 7/1975 | Ivy | 223/99 |
| 4,300,463 | A | 11/1981 | Morimoto | |
| 5,682,830 | A | 11/1997 | Katou et al. | |

FOREIGN PATENT DOCUMENTS

| | | |
|---|---|---|
| JP | 51-24353 | 2/1976 |
| JP | A 2-99088 | 4/1990 |
| JP | A 6-254279 | 9/1994 |
| JP | A-07-39669 | 2/1995 |
| JP | A 8-173676 | 7/1996 |
| JP | A-09-239183 | 9/1997 |
| JP | A 9-299676 | 11/1997 |
| JP | A-09-299677 | 11/1997 |
| JP | A-10-211375 | 8/1998 |
| JP | B2-3178022 | 4/2001 |
| JP | A 2001-218992 | 8/2001 |

* cited by examiner

*Primary Examiner*—Danny Worrell
(74) *Attorney, Agent, or Firm*—Oliff & Berridge, PLC

(57) ABSTRACT

A sewing machine includes a threader including a threading nook for passing a thread through an eye of a needle, and a thread drawer including a thread drawing member wiping the thread extending through the needle eye downward, the thread drawing member also drawing a looped thread having been passed through the needle eye by the threading hook.

7 Claims, 13 Drawing Sheets

SEWING MACHINE

INCORPORATION BY REFERENCE

This is a Continuation of Application No. 10/757,448 filed Jan. 15, 2004 now U.S. Pat. No. 6,941,881, which claims priority of Japanese Patent Application No. 2003-013343, filed Jan. 22, 2003, the entire disclosures of which including the specification, drawings, and abstract, are hereby incorporated by reference herein in their entirety.

BACKGROUND OF THE INVENTION

1. Field of the Invention

This invention relates to a sewing machine in which a sewing thread can automatically be released from a thread loop formed when a sewing needle is threaded, a threading control program and a recording medium on which the threading control program is recorded.

2. Description of the Related Art

There have conventionally been proposed sewing machines provided with threading means for automatically threading a sewing needle. For example, JP-8-173676-A discloses a technique for catching a thread by a hook having been passed through an eye of the needle and returning the hook through the needle eye such that the needle thread is passed through the needle eye, while the thread is guided by thread guide grooves or the like and held by thread holders. JP-6-254279-A discloses thread drawing means for wiping a leading end of the cut thread off the cloth after a thread cutting operation such as in completion of sewing and introducing the thread end to an upper thread nipper.

In the sewing machine disclosed in JP-8-173676-A, however, the thread having been passed through the needle eye forms a loop between the needle eye and the hook. The thread loop is drawn with fingers of an operator so that a free end side part of the thread is pulled back through the needle eye, whereby the needle is threaded. JP-51-24353-A discloses a first nipper holding a thread cut during the sewing and a second nipper catching the thread held by the first nipper. The thread caught by the second nipper is passed through the needle eye by a thread extruder. The thread having been passed through the needle eye is caught by a third nipper, which is then moved upward so that the thread is completely passed through the needle eye. In the disclosed sewing machine, however, three nippers are provided for catching and pulling back the thread through the needle eye. Moreover, since the three nippers are moved individually, the structure of the sewing machine is complicated.

SUMMARY OF THE INVENTION

Therefore, an object of the present invention is to provide a sewing machine including a threader including a threading hook for passing a thread through an eye of a needle. The sewing machine preferably includes a threader driver driving the threader so that the threading hook is advanced through or retreated through the eye of the needle. The sewing machine preferably includes a thread drawer including a thread drawing member wiping the thread extending through the needle eye downward, the thread drawing member also drawing a looped thread having been passed through the needle eye by the threading hook. The sewing machine preferably includes a thread drawer driver provided independent of the threader driver for moving the thread drawer so that the thread is wiped and a thread loop is released from a looped state. The sewing machine preferably includes a control unit controlling the threader driver and the thread drawer driver.

The present invention provides a sewing machine, wherein the control unit controls the threader driver so that the threading hook, after having been advanced through the needle eye, is retreated through the needle eye, whereupon a thread loop is formed by the thread having been passed through the needle eye, and the control unit controls the thread drawer driver so that the thread drawer is moved so that the thread is drawn to a position where the thread is released from a looped state.

The present invention provides a sewing machine, wherein a part of the thread between the needle and the threading hook is drawn by the thread drawing member while the threading hook in engagement with the thread is spaced away from the needle rearward.

The present invention provides a sewing machine, wherein the thread drawing member draws a free end side of the looped thread formed by the threading hook.

The present invention provides a sewing machine, wherein the control unit controls the thread drawer driver so that the thread drawer is moved to wipe the thread extending downward from the needle eye, and the thread drawing member has a shorter distance of movement in a case of releasing the thread from the looped state than a distance of movement in a case of wiping the thread.

The present invention provides a sewing machine, wherein the thread drawing member releases the thread from the looped state in a middle of a movement locus thereof in a case of wiping the thread.

The present invention provides a sewing machine, wherein the sewing machine is a multi-needle sewing machine including a plurality of needle bars provided with needles respectively.

The present invention provides a sewing machine, including a threader including a threading hook. The threading hook is preferably configured to pass through an eye of a needle, and after passing through the eye of the needle, engage a thread. After engaging the thread, the treading hook preferably withdraws from the eye of the needle such that the thread passes through the eye of the needle. The sewing machine preferably includes a thread drawer including a thread drawing member wiping the thread extending through the needle eye downward, the thread drawing member preferably drawing a looped thread having been passed through the needle eye by the threading hook.

BRIEF DESCRIPTION OF THE DRAWINGS

Other objects, features and advantages of the present invention will become clear upon reviewing the following description of the invention with reference to the accompanying drawings, in which.

DETAILED DESCRIPTION OF THE INVENTION

One embodiment of the present invention will be described with reference to the drawings. In the embodiment, the invention is applied to an industrial or occupational multi-head sewing machine including three multi-needle embroidery sewing machines which can embroider three same embroidery patterns on respective caps at the same time.

Figure 1:
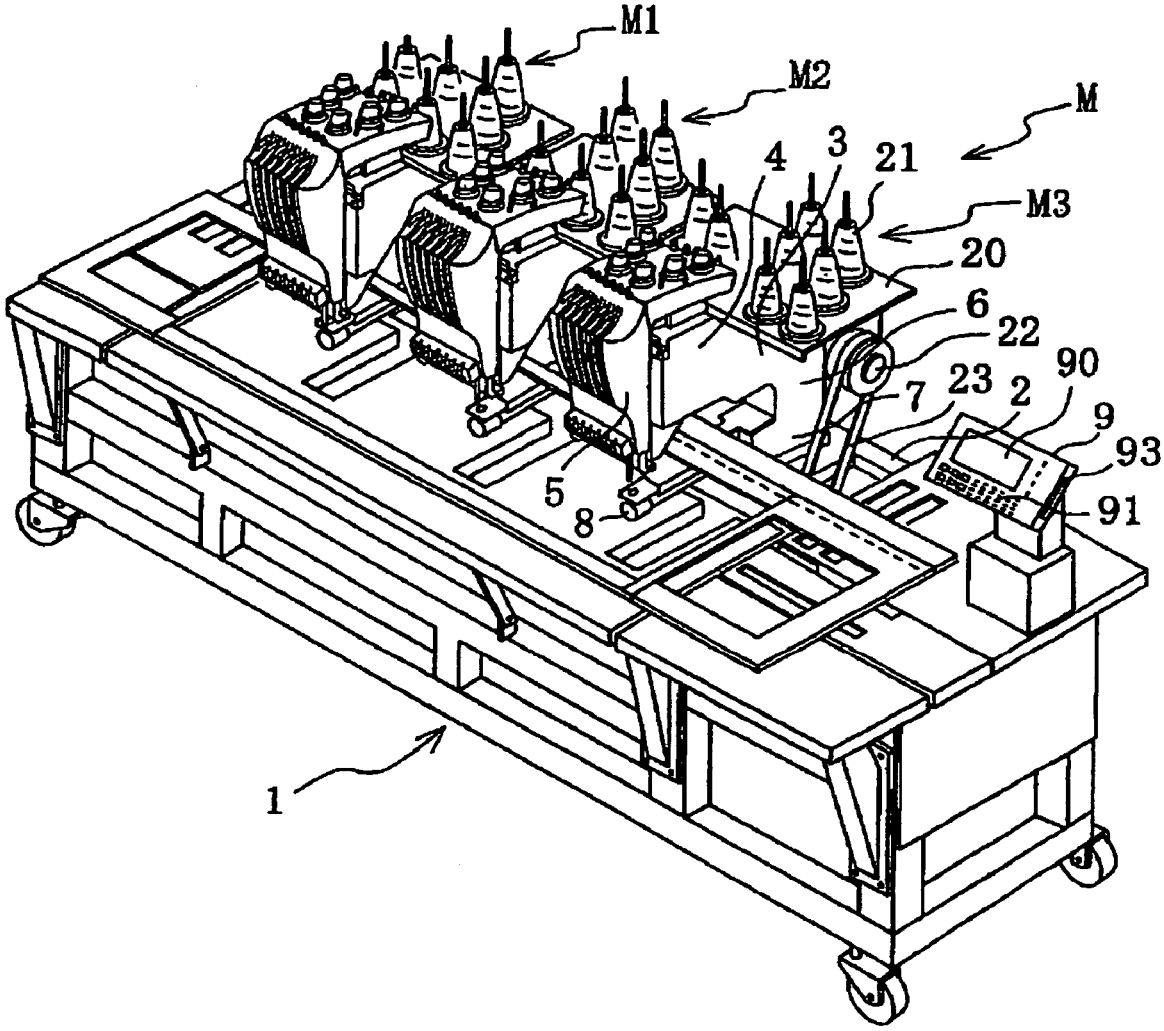
FIG. 1 is a perspective view of a multi-head sewing machine in accordance with one embodiment of the present invention.

The multi-head sewing machine M will first be described. Referring to FIG. 1, the multi-head sewing machine M comprises an embroidering machine body frame 1 extending in the right-and-left direction, and a generally rectangular machine support plate 2 mounted on the rear top of the frame 1 so as to extend in the right-and-left direction. Three multi-needle embroidery sewing machines M1 to M3 are mounted on the support plate 2 so as to be juxtaposed in the right-and-left direction. The embroidery sewing machines M1 to M3 have the same structure.

Each of the embroidery sewing machines M1 to M3 includes an arm 3 having a distal end on which a sewing head 4 is mounted. The head 4 has a front end on which a needle bar case 5 is mounted so as to be moved in the right-and-left direction. Six needle bars 10 are supported on the needle bar case 5 so as to be vertically moved. A sewing needle 15 having a needle eye 15*a* is fixed to each needle bar 10. A stud 6 is continuous to the arm 3 and has a lower end to which a sewing bed body 7 is continuous. The sewing bed body 7 is fixed to the machine support plate 2. The sewing bed body 7 has a front end from which a cylinder bed 8 extends forward. The cylinder bed 8 has a front end on which a thread loop taker (not shown) and the like are provided. The multi-head sewing machine M includes an operation panel 9 disposed at the right end thereof. An operator operates the operation panel 9 to enter various commands.

Figure 3:
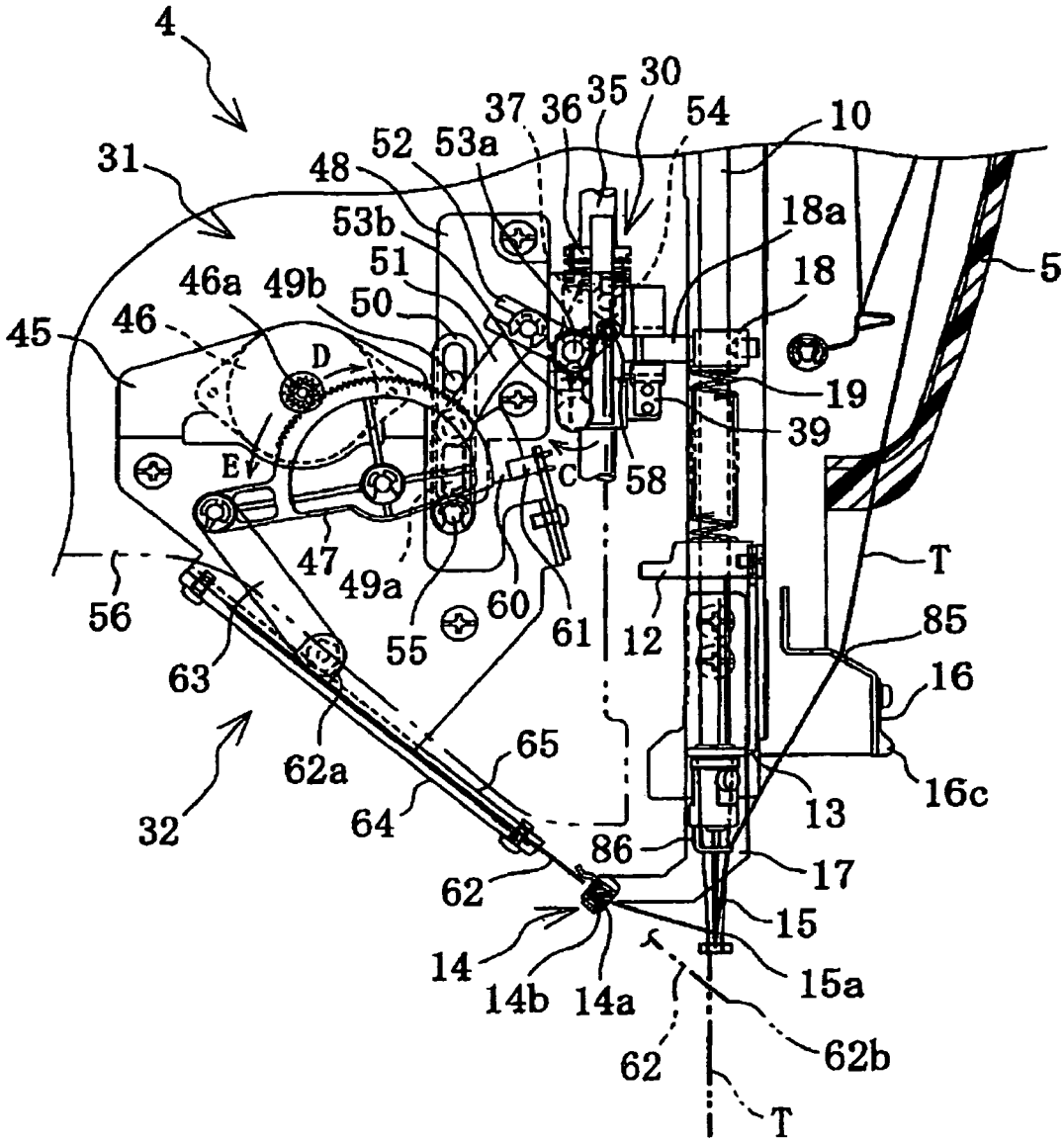
FIG. 3 is a partial left side view of an embroidery sewing machine.
Figure 4:
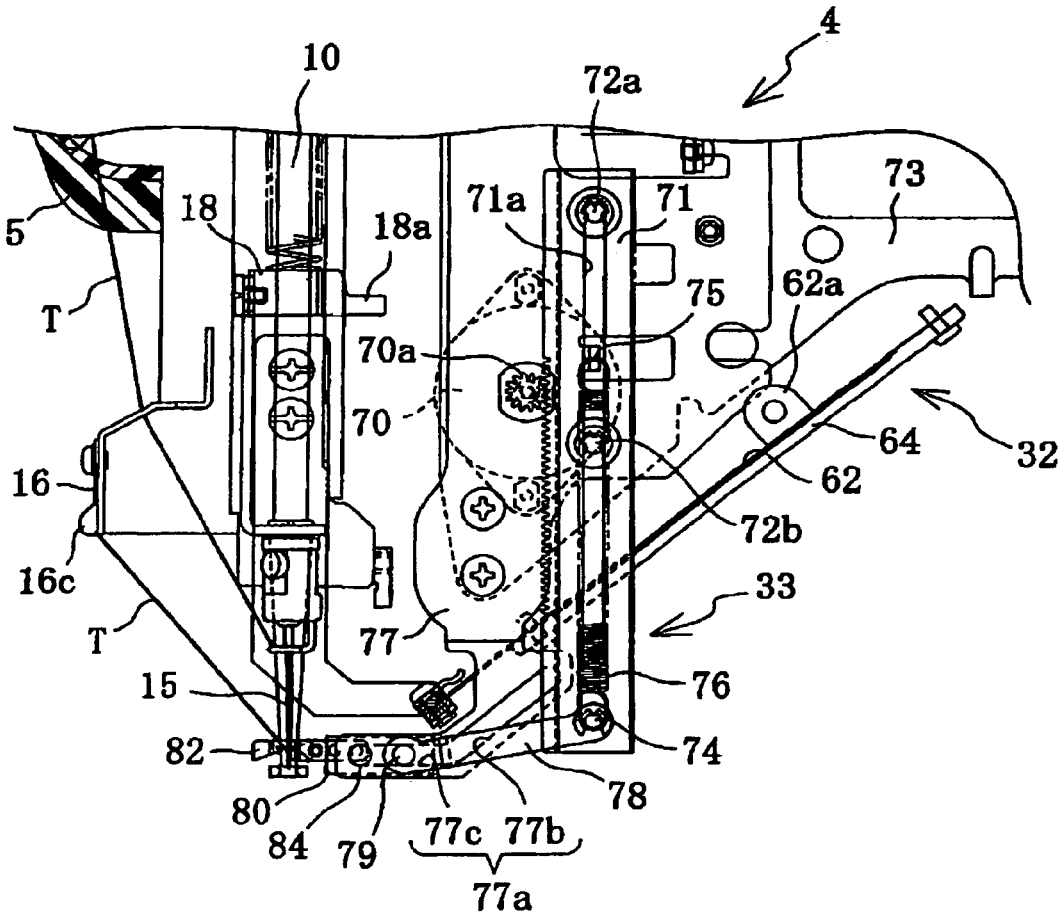
FIG. 4 is a partial right side view of the embroidery sewing machine.

Referring now to FIGS. 3 and 4, each head 4 includes the needle bar case 5, a lift driving mechanism 30 transmitting a vertically driving force from a sewing machine motor 110 to the needle bar 10 and a needle bar releasing mechanism 31 cutting off transmission of driving force between the needle bar 10 and the lift driving mechanism 30. Each head 4 further includes a thread drawing mechanism 32 further including a thread drawing member 62 and a threading mechanism 33 passing a thread through an eye 15*a* of a sewing needle 15 by means of a threading hook 83.

Figure 2:
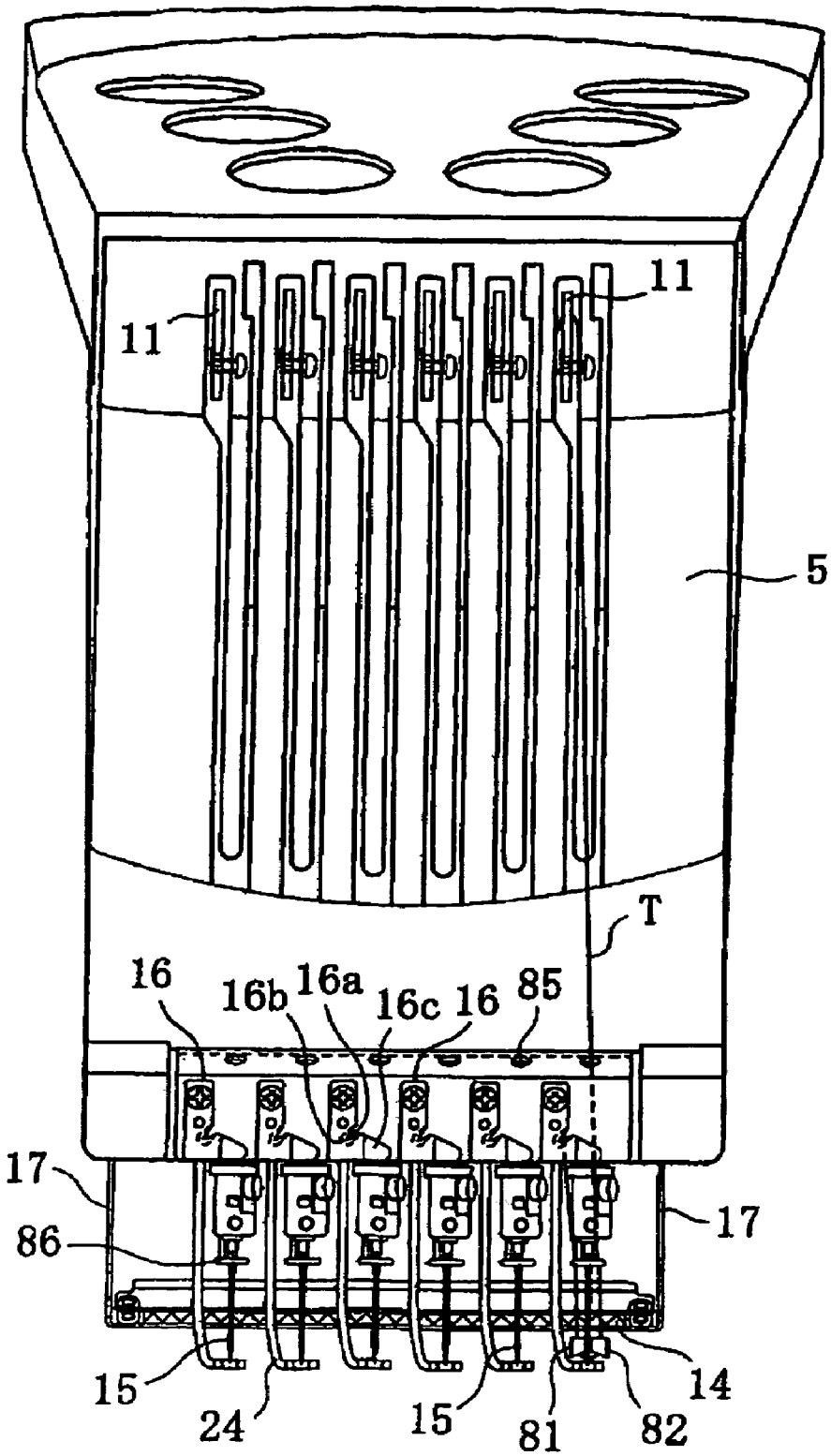
FIG. 2 is a front view of a needle bar case.

Referring to FIGS. 2 and 3, each needle bar case 5 includes six vertically extending needle bars 10, six needle thread take-up levers 11 located so as to correspond to the respective needle bars 10 and attached so as to be moved vertically. Each needle bar case 5 further includes first and second needle bar guiding members 12 and 13 both fixed to the needle bar case 5 to guide the needle bar 10 and a first thread holding member 14 extending in the right-and-left direction and supported on a fixing plate 17 having both ends secured to the needle bar case 5. Each needle bar case 5 still further includes six second thread holding members 16 disposed so as to correspond to the respective needles 15 and six presser feet 24 disposed so as to correspond to the respective needles 15.

A connecting member 18 is secured to a middle portion of each needle bar 10. The connecting member 18 includes a connecting pin 18*a* to which a driving force from the lift driving mechanism 30 is transmitted. A compression coil spring 19 is provided around the needle bar 10 between the connecting member 18 and the first needle bar guiding member 12. The compression coil spring 19 biases the needle bar 10 upward. The needles 15 are attached to the lower ends of the respective needle bars 10. An embroidering thread T is supplied from a thread spool 21 mounted on a spool holder base 20 to each of the six needles 15.

The first thread holding member 14 holds the thread T drawn by the thread drawing mechanism 32. The first thread holding member 14 includes a thread holding tape 14*a* further including hook sides of two pieces of hook-type magic tape (registered trademark). The hook sides are superposed so as to confront each other. The first thread holding member 14 further includes a pair of reinforcing plates 14*b* holding the thread holding tape 14*a* therebetween.

Each second thread holding member 16 preliminarily holds a leading end of the thread T caught on the threading hook 83 before the thread T is passed through the needle eye 15*a*. The second thread holding member 16 includes a holding portion 16*a* holding the thread T cut by a blade 16*a* and a guiding portion 16 chaving a forwardly protruding distal end and guiding the thread T to the holding portion 16*a*. The operator passes the thread T from the right side to the rear of the guiding portion 1*c*. When guided to the blade 16*a*, the thread T is drawn downwardly forward so that the thread T is cut by the blade 16*a* and held by the holding portion 16*b* and the front of the needle bar case 5 therebetween. Thus, the leading end of the thread T is held.

Each needle bar case 5 is moved right and left so that a desired one of the needles 15 is switched into a sewing position corresponding to a needle hole (not shown) formed in the distal end of the cylinder bed 8, whereby one of the needle bars 10 is selected. A rotating force developed by the motor 110 is transmitted via the driving shaft 22, a V belt and the like to the lift driving mechanism 30 as a vertically driving force. The lift driving mechanism 30 is then driven vertically so that the needle bar 10 is vertically moved and accordingly, the corresponding needle thread take-up lever 11 is vertically swung. Further, stitches are formed using the thread T with a selected color by the cooperation of the needle 15 of the needle bar 10 and the thread loop taker.

Figure 5:
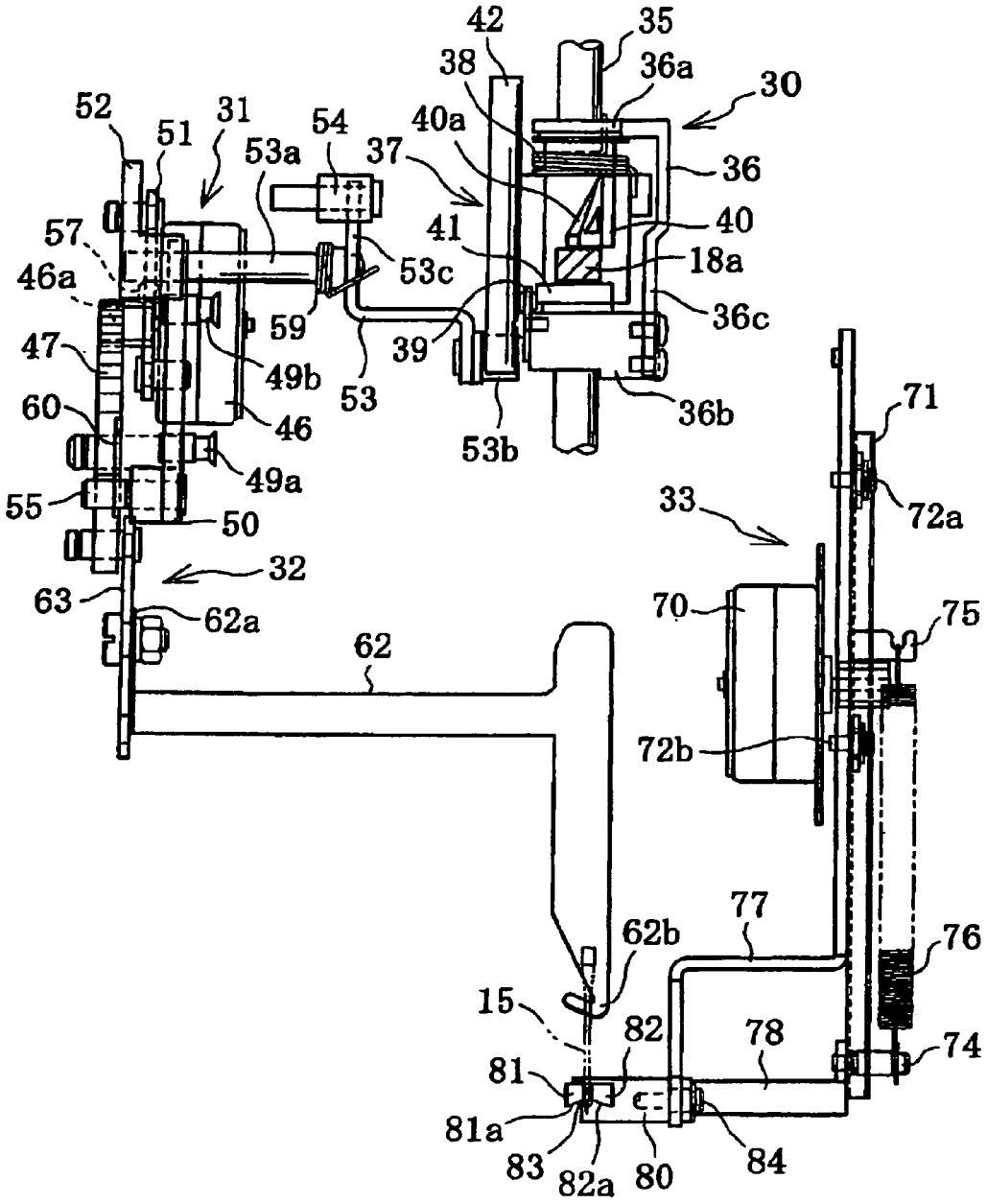
FIG. 5 is a partial front view of the embroidery sewing machine.
Figure 6:
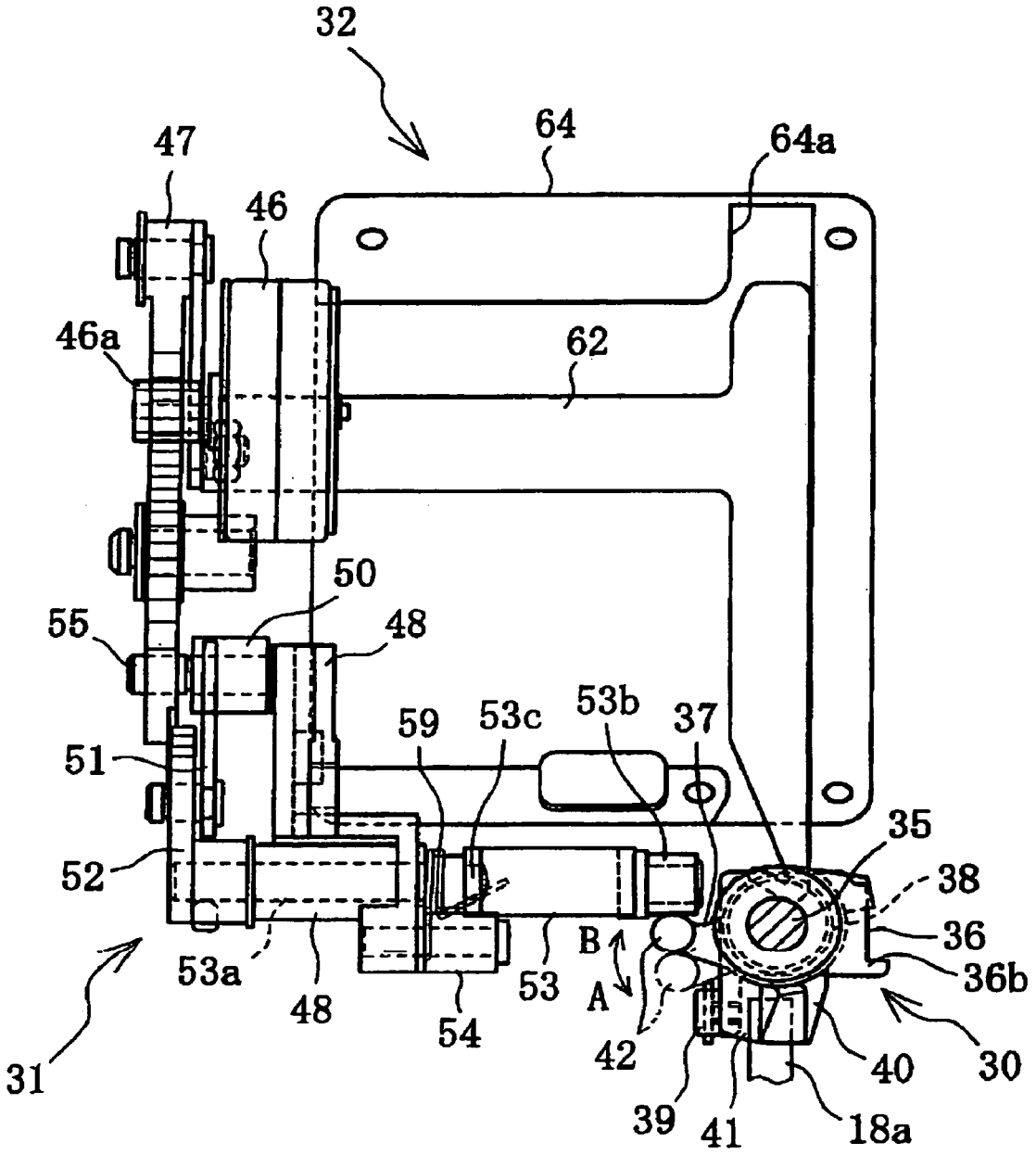
FIG. 6 is a partial plan view of the embroidery sewing machine.

Referring now to FIGS. 3, 5 and 6, the lift driving mechanism 30 includes a base needle bar 35 disposed in parallel with the needle bar 10 and a driving member 36 mounted on the base needle bar 35 so as to be slidable and non-rotatable. The lift driving mechanism 30 further includes a transmitting member 37 mounted so as to be vertically driven together with the driving member 36 and so as to be rotatable relative to the base needle bar 35. The lift driving mechanism 30 still further includes a first coil spring 38 having one of two ends abutting the driving member 36 and the other end abutting the transmitting member 37 so that the transmitting member 37 is biased to a transmitting position where the driving force is transmitted to the needle bar 10.

The driving member 36 includes upper and lower driving members 36*a* and 36*b* both fitted with the base needle bar 35 and a connecting portion 36*c* connecting the upper and lower driving members 36*a* and 36*b*. A first coil spring 38 is fitted with the upper driving member 36*a*. A stopper 39 is secured to a left side of the lower driving member 36*b*. The stopper 39 limits rotation of the transmitting member 37 to a predetermined angle. The transmitting member 37 is disposed between the upper and lower driving members 36*a* and 36*b*. The transmitting member 37 includes first and second engaging members 40 and 41 engaging the connecting pin 18*a* and an abutment pillar 42 to which a rotating force from the needle bar releasing mechanism 31 is transmitted in order that the needle bar 10 may be released. The first engaging member 40 includes an inclined portion 40*a* turning the transmitting member 37 in the direction of arrow A in FIG. 6 when the connecting pin 18*a* in the released state abuts the first engaging member 40.

The needle bar releasing mechanism 31 includes a driving motor 46 mounted on the fixing member 45 and comprising a pulse motor and a sector gear 47 in mesh engagement with an output shaft 46*a* of the driving motor 46. The needle bar releasing mechanism 31 further includes a guided plate 50 guided by guide pins 49*a* and 49*b* secured to the fixing member 48 so that the guided member is vertically moved. The needle bar releasing mechanism 31 still further includes a first linking member 51 having a lower end connected to a central portion of the guided plate 50 so that the lower end is swung and a second linking member 52 connected to an upper end of the first linking member 51 so as to be swung, an abutting member 53 swung with the second linking member 52 and a stopper 54 fixed to the fixing member 48. The sector gear 47 has a front half further having a lower end abutting an abutment pin 55 secured to a lower end of the guided plate 50. The fixing members 45 and 48 are fixed to a left-side sewing machine frame 56.

The abutting member 53 includes a shaft 53*a* rotatably mounted on the fixing member 48 and fixed to the second linking member 52 by a small screw 57, a first abutting portion 53*b* abutting the abutment pillar 42 of the transmitting member 37 and a second abutting portion 53*c* abutting the stopper 54. A second coil spring 59 is wound on a right end of the shaft 53*a*. The second coil spring 59 has one end fixed to a screw 58 in thread engagement with the fixing member 48. The abutting member 53 is biased in the direction of arrow C in FIG. 3 by the second coil spring 59 except when the needle bar 10 is jumped, whereupon the second abutting portion 53*c* is in abutment with the stopper 54.

In order that the needle bar 10 may be jumped to be released by the needle bar releasing mechanism 31, the driving motor 46 is driven so that the sector gear 47 is rotated in the direction of arrow Din FIG. 3, whereby the guided plate 50 is moved downward. The movement of the guided plate 50 further moves the lower end of the first linking member 51 downward. With the downward movement of the first linking member 51, the second linking member 52 is rotated in the direction opposite arrow C about the shaft 53*a* together with the abutting member 53. By the rotation, the abutting member 53 presses the abutment pillar 42 of the transmitting member 37 which is further in abutment with the first abutting portion 53*b*, so that the transmitting member 37 is rotated in the direction of arrow A in FIG. 6 until the abutment pillar 42 abuts the stopper 39 (see the abutment pillar 42 shown by two-dot chain line in FIG. 6). As the result of rotation of the transmitting member 37, the first and second engaging members 40 and 41 are released from engagement with the connecting pin 18*a*. Consequently, the needle bar 10 is biased by the compression coil spring 19 thereby to be caused to jump to an upper limit position, whereby the needle bar 10 is in a released state in which a lifting force of the lift driving mechanism 30 is prevented from being transmitted to the needle bar 10.

On the other hand, in order that the needle bar 10 may be switched from the released state to a transmissible state in which the lift driving force of the lift driving mechanism 30 is transmissible to the needle bar 10, the transmitting member 37 is moved upward by the sewing machine motor 110 so that the connecting pin 18*a* abuts the inclined portion 40*a* from above, whereby the transmitting member 37 is rotated in the direction of arrow A in FIG. 6. Further, when moved upward so that the connecting pin 18*a* is located between the first and second engaging members 40 and 41, the transmitting member 37 is rotated in the direction of arrow B in FIG. 6 by the biasing force of the coil spring 38, whereby the connecting pin 18*a* engages the first and second engaging members 40 and 41 such that the needle bar 10 is in the transmissible state.

The thread drawing mechanism 32 wipes the thread T extending downward through the needle eye 15*a* when the thread has been cut by a thread cutting mechanism (not shown) provided in the cylinder bed 8 at the time of completion of the sewing or needle change. The thread having been passed through the needle eye 15*a* and having a loop L is released from a looped state by the thread drawing mechanism 32 and caught on the threading hook 83.

Referring to FIGS. 3, 5 and 6, the thread drawing mechanism 32 includes the driving motor 46, the sector gear 47 formed with a detected portion 60, a thread drawing member origin detector 61 for detecting the detected portion 60, and a thread drawing member 62. The thread drawing mechanism 32 further includes a coupling plate 63 having both ends coupled to the thread drawing member 62 and the sector gear 47 respectively so that the coupling plate 63 is swung. The thread drawing mechanism 32 still further includes a guiding member 64 guiding the thread drawing member 62 and a cover 65 for the guiding member 64. The thread drawing member 62 includes a standing portion 62*a* coupled to the coupling plate 63 so as to be swung and a hook 62*b* for drawing the thread T. The thread drawing member 62 is held between the guiding member 64 and the cover 65 and supported in a guide groove 64*a* formed in the guiding member 64 so that the thread drawing member 62 is slid. The origin detector 61 comprises a photo-interrupter including a light emitting element and a light detecting element. The origin detector 61 detects, as an origin, a position of the thread drawing member 62 when the lower edge of the detected portion 60 passes between the light emitting and detecting elements. The guide groove 64 guiding the thread drawing member 62 is formed so that the thread drawing member 62 is allowed to be moved rearward from a standby position as shown in FIGS. 4 and 6 when the driving motor 46 is driven to rotate in the direction of arrow D in FIG. 3 in order that the needle bar releasing mechanism 31 may be driven.

In wiping the thread, the sector gear 47 to which the driving force is transmitted from the driving motor 46 is rotated in the direction of arrow E in FIG. 3. With the rotation of the motor 46, the coupling plate 63 is moved downwardly forward so that the thread drawing member 62 coupled to the lower end of the coupling plate 63 passes through the first thread holding member 14 while being guided by the guide groove 64*a*. Thus, the thread drawing member 62 is slid to the thread wiping position where the hook 62*b* is located below the needle 15. The hook 62*b* is engaged with the thread T which extends downward after having been passed through the needle eye 15*a* (see two-dot chain line in FIG. 3). When the thread drawing member 62 is returned to the standby position in the aforesaid state, the thread T in engagement with the thread drawing member 62 is held by the thread holding tape 14*a* of the first thread holding member 14 when passing through the first holding member 14.

Referring now to FIGS. 4 and 5, the threading mechanism 33 includes a threading motor 70 comprising a pulse motor, a rack 71 meshed with an output shaft 70*a* of the threading motor 70 and having a guide groove 71*a* which is engaged with guide pins 72*a* and 72*b* fixed to the right machine frame 73, and an extension spring 76 having two ends. One end of the extension spring 76 is connected to a connecting pin 74 fixed to a lower end of the rack 71 and the other end of the extension spring 76 is connected to a connecting protrusion 75 fixed to a guide frame 77. As a result, the extension spring 76 biases the rack 71 upward. The threading mechanism 33 further includes the guide frame 77 fixed to the right machine frame 73 and formed with a guide groove 77*a*, a crank plate 78 located on the right of the guide frame 77 and connected via the connecting pin 74 to a lower end of the rack 71, and a link block 80 formed into the shape of a rectangular parallelepiped. A first guided pin 79 is engaged with a guide groove 77*a* formed in a lower end of the crank plate 78. The link block 80 is connected via the first guided pin 79 to a left side of the guide frame 77 so as to be moved. The threading mechanism 33 still further includes a pair of right and left thread catching members 81 and 82 fixed to a distal end of the link block 80 and having inclined portions 81*a* and 82*a* both guiding the thread T to the threading hook 83. The threading hook 83 has a hook 83*a* on which the thread T held between the thread catching members 81 and 82 is caught. A threading hook detector 111 (see FIG. 12) detects a position of the threading hook 83.

A second guided pin 84 engaged with the guide groove 77*a* is fixed to a middle portion of the link block 80. The guide groove 77*a* includes an inclined portion 77*b* and a horizontal portion 77*c*. In the threading operation, the link block 80 is firstly guided downwardly forward and horizontally forward subsequently.

Figure 7:
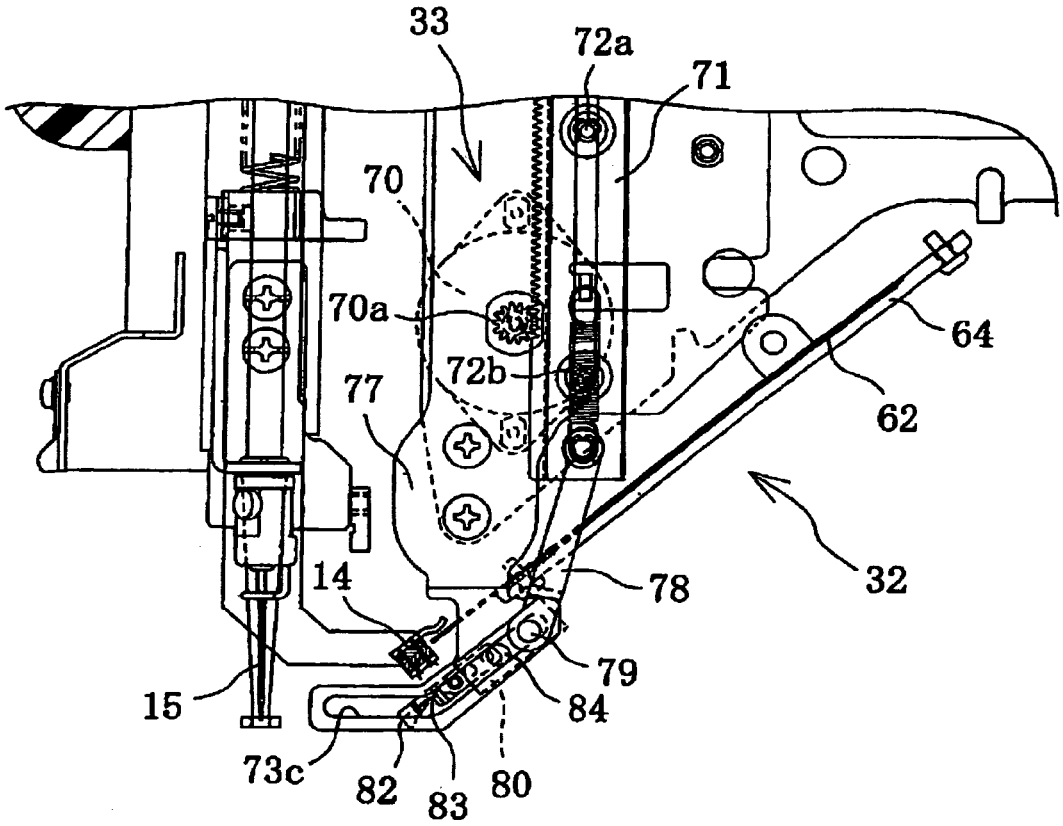
FIG. 7 is a right side view of the embroidery sewing machine, showing a stage of a threading operation.
Figure 9:
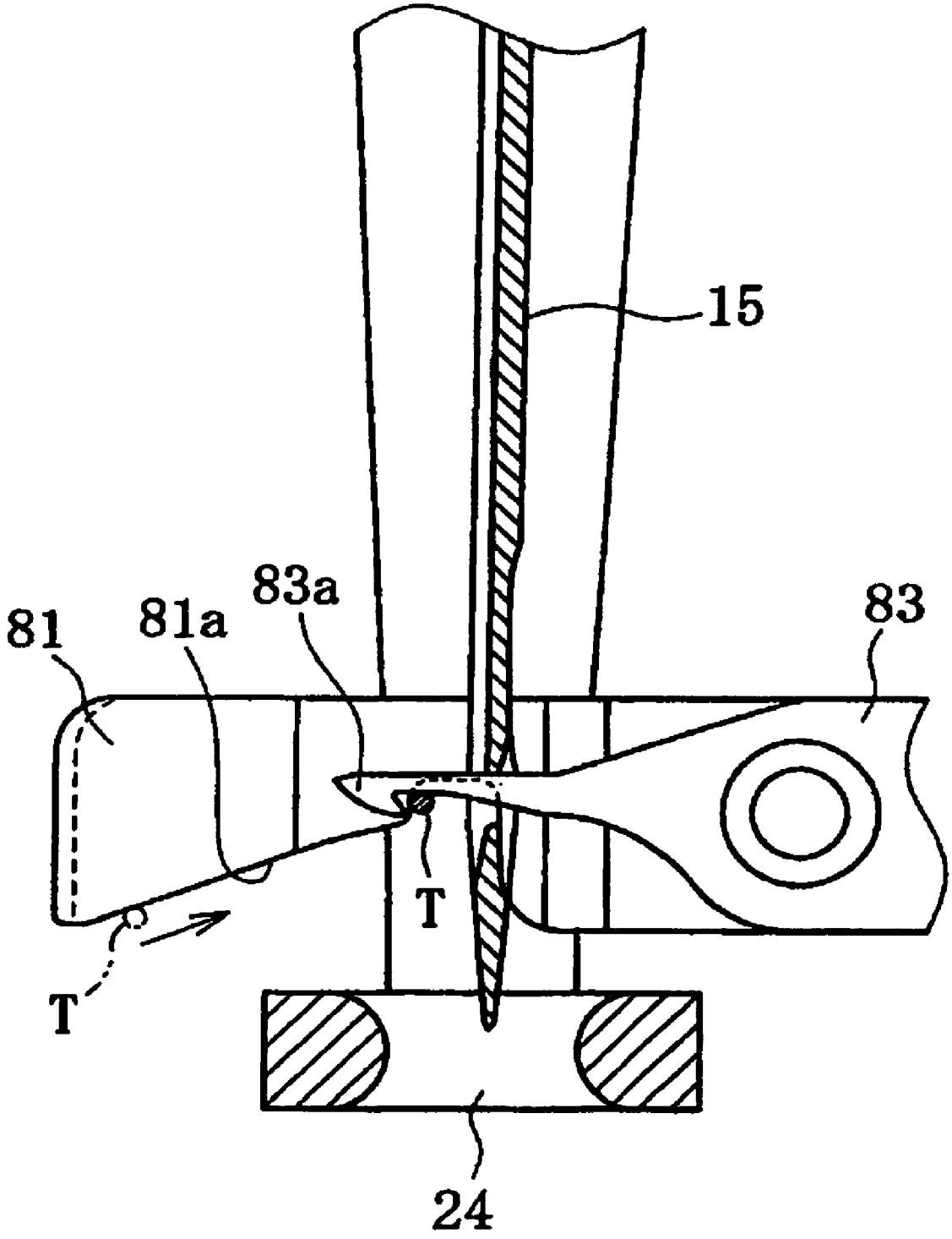
FIG. 9 is a longitudinal section of a sewing needle and its periphery in the threaded state.

A threading operation by the thread drawing mechanism 32 and the threading mechanism 33 will now be described. FIG. 7 illustrates the threading hook 83 and the thread drawing member 62 both of which are in the standby state. In this state, the threading motor 70 is driven to move the rack 71 downward while the rack 71 is being guided by the guide pins 72*a* and 72*b*. As a result, the crank plate 78 connected to the rack 71 and the link block 80 connected to the crank plate 78 are firstly moved downwardly forward along the inclined portion 77*b* of the guide groove 77*a* and subsequently horizontally forward along the horizontal portion 77*c*. Further, the link block 80 is moved so that the hook portion 83*a* of the threading hook 83 passes through the needle eye 15*a* as shown in FIGS. 4 and 9. The link block 80 is stopped at a thread catching position where the second guided pin 84 abuts the front end of the guide groove 77*a*.

Figure 10:
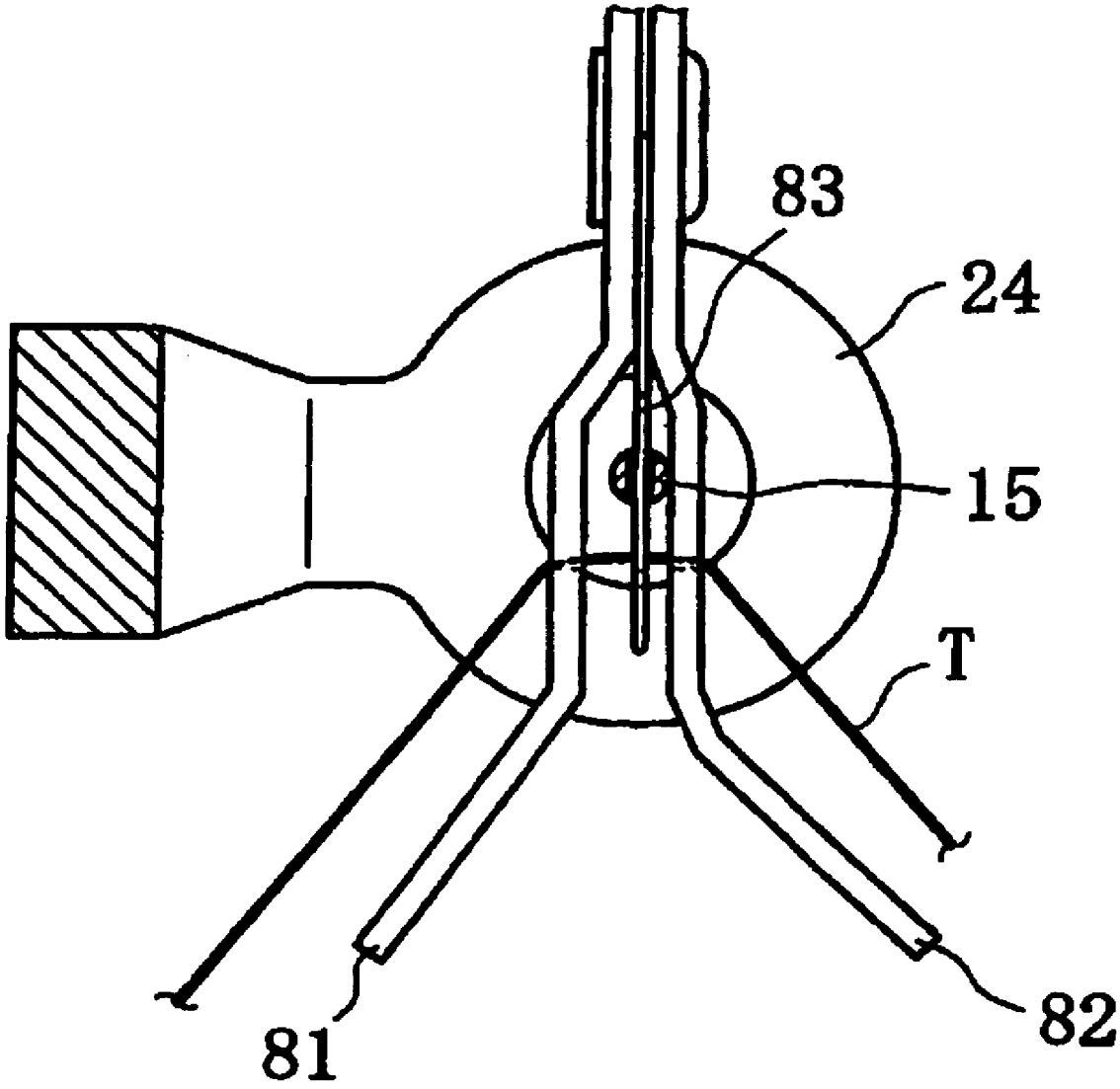
FIG. 10 is a plan view of a sewing needle and its periphery in the threaded state.

Referring to FIGS. 2 and 4, the operator sets the thread T guided by the thread guides 85 and 86 and the like, on the thread catching members 81 and 82 from the right side. The thread T is then cut by the blade 16*a* of the second thread holding member 16. A free end of the thread T is held between the holding portion 16*b* and front face of the needle bar case 5, whereby the thread T is held. In this case, when the operator upwardly draws the thread T caught on the thread catching members 81 and 82, the thread T is guided to the threading hook 83 by the inclined portions 81*a* and 82*a* of the respective thread catching members 81 and 82 to be caught on the hook portion 83*a*, as shown in FIGS. 9 and 10.

Figure 8:
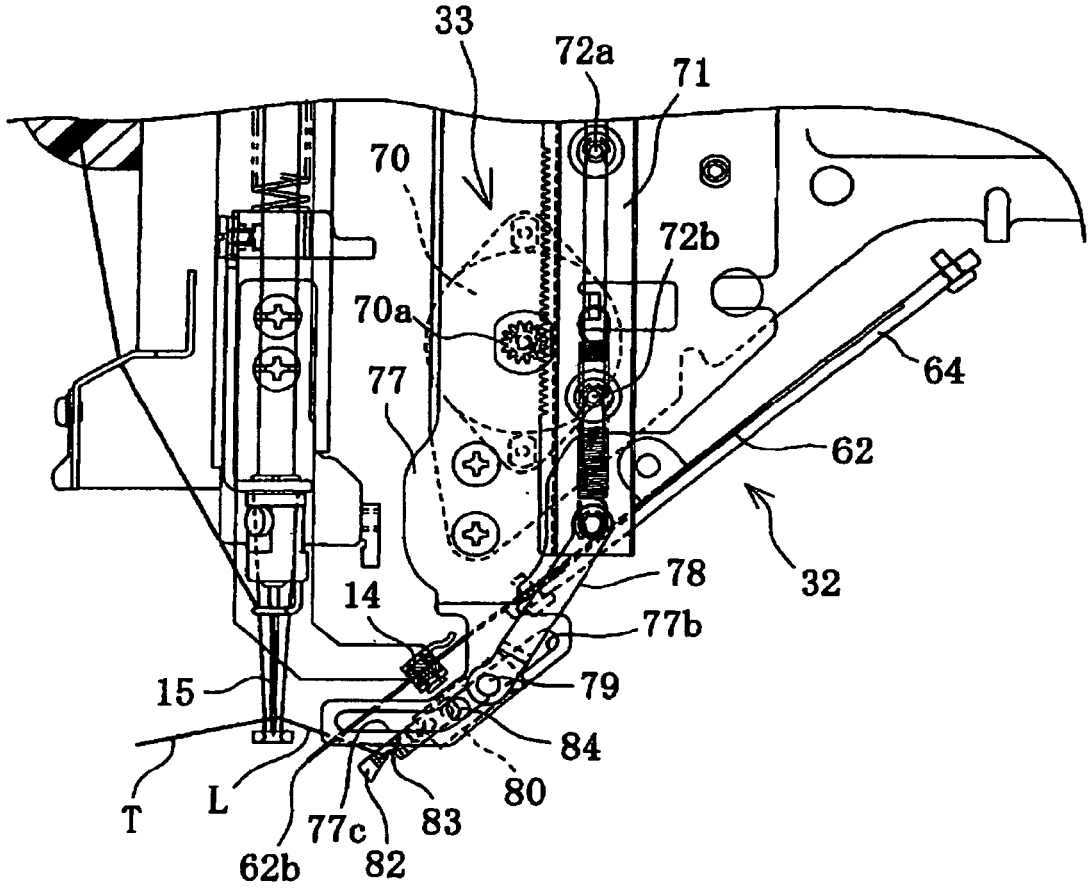
FIG. 8 is also a right side view of the embroidery sewing machine, showing another stage of the threading operation.
Figure 11:
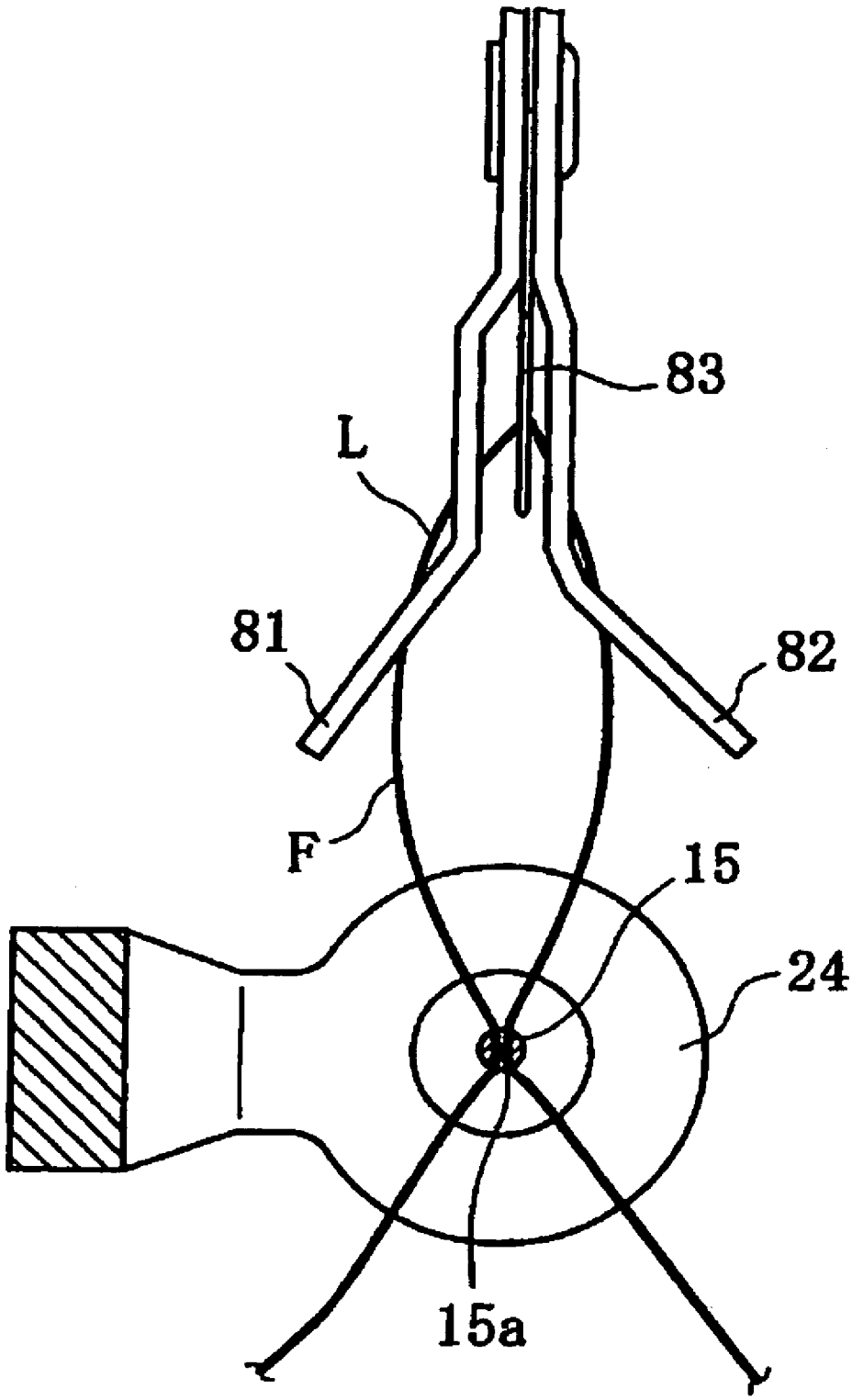
FIG. 11 is a plan view of the sewing needle and its periphery with a thread loop being formed.

Subsequently, the threading motor 70 is driven to move the threading hook 83 rearward by a predetermined distance. The threading hook 83 is stopped at a thread releasing position located in the rear of the needle 15. The driving motor 46 is then driven to move the hook portion 62*b* of the thread drawing member 62 through a thread loop L to a thread drawing position located lower than the loop L on the same locus as that in the thread wiping operation, so that the free end side F of the thread loop L is engaged with the hook portion 62*b*, as shown in FIG. 8. This thread drawing position is located higher than the thread wiping position and a distance of the hook portion 62*b* moved is shorter than that in the thread wiping. In this case, the free end of the thread T held by the second thread holding member 16 is released such that the thread T is loosened, and the thread loop L is in engagement with the threading hook 83. Accordingly, the width of the thread loop L in the right-and-left direction is increased without the thread loop hanging down between the threading hook 83 and the needle eye 15*a*, as shown in FIG. 11. Further, since the hook 83*a* is located lower than the needle eye 15*a*, the thread loop L is substantially perpendicular to the thread drawing member 62, as shown in FIG. 8. Consequently, the thread drawing member 62 can reliably be passed through the loop L and engaged with the thread T.

Subsequently, when the thread drawing member 62 is returned to the standby position by the driving motor 46, the free end side F of the thread loop L held between the threading hook 83 and the needle eye 15*a* is drawn so that the thread loop L is pulled back through the needle eye 15*a* and disengaged from the threading hook 83. Consequently, the thread T forming the loop L is released from the looped state. Further, the thread T is held by the thread holding tape 14*a* of the first thread holding member 14 when the thread drawing member 62 passes the first thread holding member 14 while drawing the free end side F of the thread T. Thus, the thread T is completely passed through the needle eye 15*a*. Subsequently, the threading motor 70 is driven to return the threading hook 83 to the standby position, whereby the threading operation is completed.

On the other hand, the operation panel 9 is operated so that various commands concerning the sewing or the like are supplied. The operation panel 9 includes a display 90, input means 91 including a threading switch 92 (see FIG. 12) and a flexible disc drive (FDD) 93. The threading switch 92 is operated so that a command for operating the threading mechanism 33 is supplied and so that a command for operating the thread drawing mechanism 32 releasing the thread with the loop L from the looped state.

Figure 12:
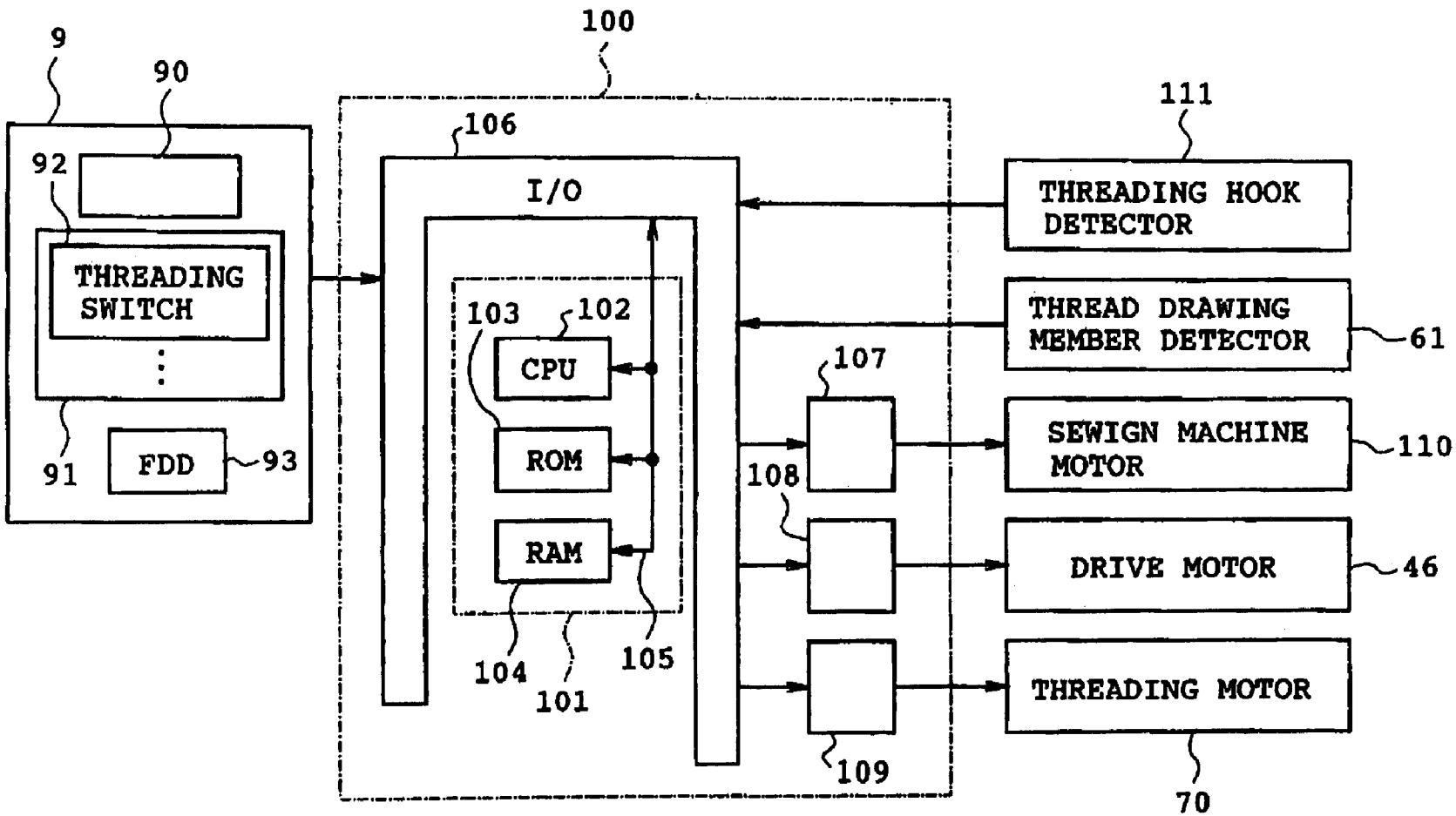
FIG. 12 is a schematic block diagram showing an electrical arrangement of a control unit.

A control unit 100 including a computer 101 will be described with reference to FIG. 12. The control unit 100 controls overall sections and mechanisms of the embroidery sewing machines M3 to M3 including the threading mechanism 33 and the thread drawing mechanism 32. The control unit 100 includes the computer 101 further including CPU 102, ROM 103, RAM 104 and buses 105 connecting these devices. The control unit 100 further includes an input/output interface 106 for input into and output from the computer 101, a drive circuit 107 connected to the input/ output interface 106 to drive the sewing machine motor 110, a drive circuit 108 for the driving motor 46 and a drive circuit 109 for the threading motor 70.

To the input/output interface 106 are connected the thread drawing member origin detector 61 detecting the position of the thread drawing member 62 and the threading hook detector 111 detecting the position of the threading hook 83. ROM 103 stores a threading control program for driving the motors 46 and 70 so that a threading operation is carried out. RAM 104 stores various data such as position data received from the thread drawing member origin detector 61 and the threading hook detector 111.

Figure 13:
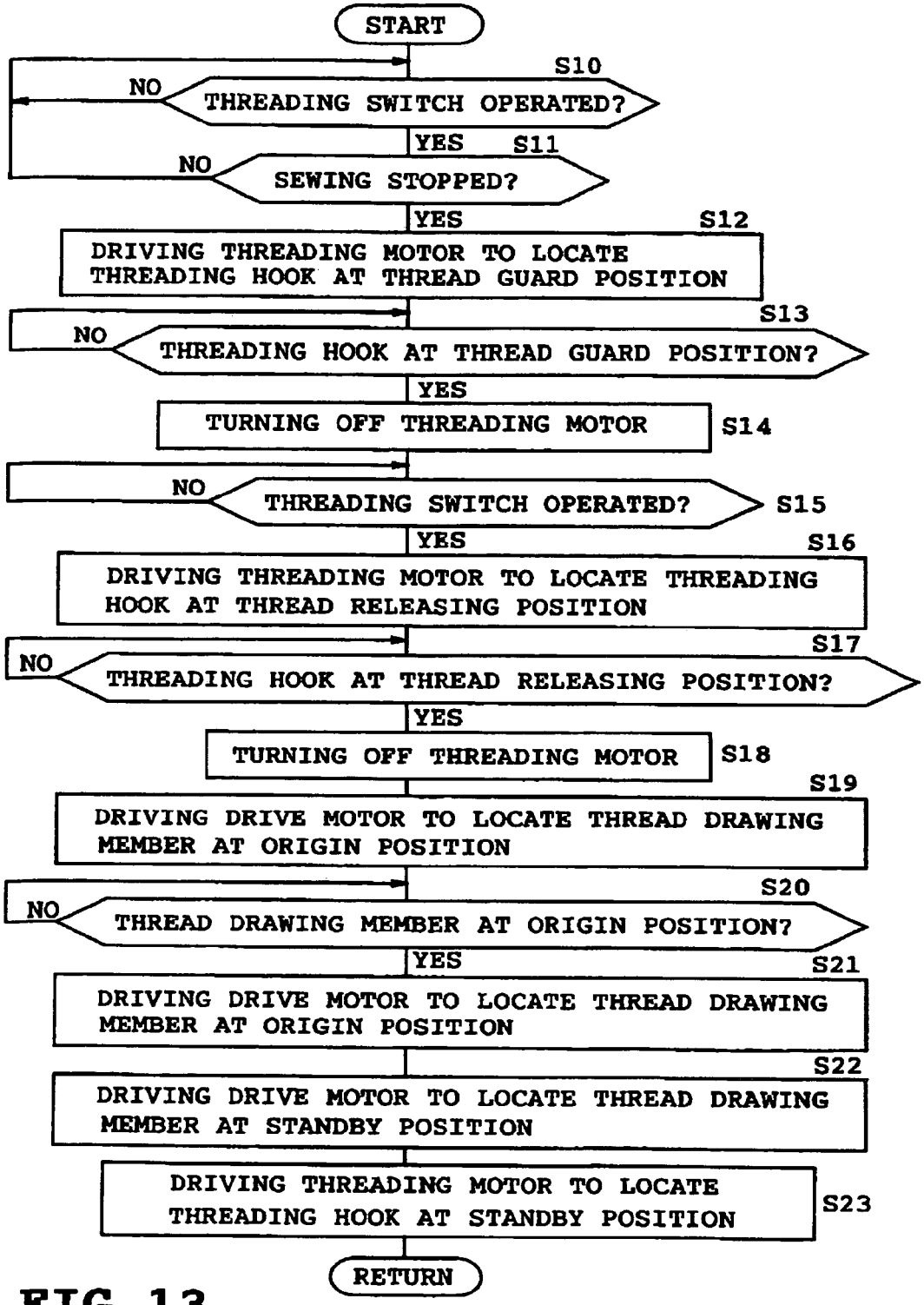
FIG. 13 is a flowchart showing a threading control program.

FIG. 13 is a flowchart showing the threading control program executed by the computer 101 of the control unit 100 in order that a thread T may be passed through the eye 15*a* of the needle 15. The threading control program will now be described. Reference symbol Si (where i=10, 11, . . . ) designates an operation step.

The operator operates the threading switch 92 of the operation, panel 9 to enter a command (step S10). The computer 101 delivers a command to the drive circuit 109 when the sewing machine is in the sewing stop state (YES at step S1). As a result, the threading hook 83 is driven by the threading motor 70, so that the threading hook 83 is moved toward the threading position while the position of the threading hook 83 is being detected by the threading hook detector 111 (step S12). When the threading hook 83 has been moved to the threading position (YES at step 513), the threading motor 70 is stopped in a state where the threading hook 83 has been passed through the needle eye 15*a* (step S14).

Subsequently, when the thread T is caught on the thread hook 83 and the threading switch 92 is then re-operated so that a command is supplied (YES at step S15), the computer 101 supplies a command to the drive circuit 109 in response to the command from the threading switch 92. As a result, the threading motor 70 is driven so that the threading hook 83 is moved backward through the needle eye 15*a* toward the thread releasing position while the position of the threading hook 83 is being detected by the threading hook detector 111 (step S16). When the threading hook 83 has reached the thread releasing position after movement by a predetermined distance (YES at step S17), threading the needle 15 is then carried out and the threading motor 70 is stopped (step S18).

Subsequently, when the computer 101 delivers a command to the drive circuit 108, the drive motor 46 is driven to rotate the sector gear 47 in the direction of arrow E in FIG. 3 so that the thread drawing member 62 is moved toward the origin (step S19). Thereafter, when the origin of the thread drawing member 62 has been detected by the origin detector 61 (YES at step S20), a predetermined number of pulses is supplied to the drive motor 46 at the origin so that the thread drawing member 62 is moved to the thread drawing position (step S21). Consequently, the free end side F of the thread loop L extending from the hook 83 to the needle eye 15*a* is engaged with the hook 62*b* of the thread drawing member 62 and thereafter, the drive motor 40 is stopped. In this case, the drive motor 46 is driven in the opposite direction so that the thread drawing member 62 with which the thread loop L is in engagement is returned to the standby position, whereupon the thread T is released from the looped state (step S22) and the threading motor 70 is driven to move the threading hook 83 to the standby position and subsequently, the threading control program is finished.

The following effects can be achieved from the above-described multi-head sewing machine M. The multi-head sewing machine is constructed so that the thread drawing member 62 of the thread wiper 32 for wiping the thread in the thread change or the like is moved to the thread drawing position, whereby the thread with the loop L between the needle eye 15*a* and the threading hook 83 in the threading operation is released from the looped state. Consequently, the number of parts of the multi-head sewing machine M is reduced such that the structure thereof can be simplified. Further, the production cost of the multi-head sewing machine M can be reduced, whereas the thread T can reliably be passed through the needle eye 15*a*. Accordingly, useless labor by the operator and a useless working time can be reduced.

Furthermore, when the thread drawing member 62 engages the thread loop L, the thread loop L is held between the needle eye 15*a* and the threading hook 83 without hanging downward. Additionally, since the distal end of the threading hook 63 is located lower than the needle eye 15*a*, the thread drawing member 62 becomes almost perpendicular to the thread loop L. Further, the thread drawing member 62 passes through the thread loop L while the thread T is released from the holding by the second thread holding member 16 such that the thread loop L is loosened into a spread state. Consequently, the thread drawing member 62 can reliably engage the thread loop L.

Furthermore, since the thread drawing member 62 engages and draws the free end side F of the thread loop L, the thread T can smoothly be pulled out through the needle eye 15*a* without uselessly drawing out the thread from the thread spool 21.

Furthermore, the distance by which the thread drawing member 62 is moved for release of the thread is shorter than that thereof for thread wiping. Further, the thread drawing position is located higher than the thread wiping position, the size of the drive motor 46 need not be increased for the purpose of release of the thread loop L. Additionally, the thread drawing member 62 is moved in the release of the looped thread along the same movement locus as in the thread wiping. Consequently, the structure of the multi-head sewing machine M can be simplified since no complicated mechanisms are required which moves the thread drawing member 62 along a complicated movement locus for the release of the thread T from the threaded loop L.

Modified forms of the foregoing embodiment will now be described. In the foregoing embodiment, the present invention is applied to the embroidery sewing machines M1 to M3 each of which is provided with the needle bar case 5 in which a plurality of needles 15 and needle bars 10 are mounted on the single head 4. However, the invention may be applied to a sewing machine comprising a single head provided with a single sewing needle.

The invention is applied to the multi-head sewing machine M composed of three embroidery sewing machines M1 to M3 in the foregoing embodiment. However, the invention may be applied to a single-head sewing machine composed of a single sewing machine. Further, the invention is applied to the industrial or occupational multi-head sewing machine M in the foregoing embodiment. However, the invention may be applied to a household sewing machine for personal use.

The lift driving mechanism 30 and the driving force transmitting means are inseparable from the cloth moving mechanism in the foregoing embodiment. However, the cloth moving mechanism may be separable from the lift driving mechanism 30 and the driving force transmitting means as disclosed in Japanese Patent No. 3178022.

In the foregoing embodiment, the threading hook 83 and the thread drawing member 62 are located in the rear of the needle 15. However, either one or both of the threading hook and thread drawing member may be disposed in front of the needle or side by side.

In the foregoing embodiment, the thread drawing member 62 passes through the thread loop L and then engages the thread T while the threading hook 83 and the thread T are in engagement with each other. However, the thread drawing member 62 may engage the thread loop while the threading hook and the thread are disengaged from each other.

The thread T is held between the thread holding tapes 14*a* of the first thread holding member 14 in the foregoing embodiment. However, unless the thread is inadvertently moved or if the thread can be released from the holding by the first thread holding member upon sewing, the thread may merely be placed on a member thereby to be held. Further, upon start of sewing, the thread T is drawn by the needle 15 without operation of the first thread holding member 14, so that the thread T is released from the held state. However, the first thread holder may comprise an actuator so that the thread is released in a positive manner, instead.

The thread drawing member 62 is reciprocally moved along a linear passage in the foregoing embodiment. However, the thread drawing member may reciprocally be moved along an arc passage or may be moved in one way along a passage. In the foregoing embodiment, the distance by which the thread drawing member 62 is moved for release of the thread loop L is shorter than that thereof for thread wiping. However, the thread drawing member 62 is moved along a linear passage both for the release of the thread loop L and for thread wiping. Two linear passages may be provided both for the release of the thread loop L and for thread wiping respectively.

In the foregoing embodiment, the invention is applied to the multi-head sewing machine M in which the operator is located in front of the sewing machine in the sewing as viewed in FIG. 1. However, the invention may be applied to a single-head sewing machine or the like in which the operator is located on the right or left of the sewing machine. Since the position of the operator changes in this sewing machine, it is desirable that the threading hook and the thread drawing member a removed along a track differing from the one in the foregoing embodiment, for example, so that the tracks of the threading hook and the thread drawing member are moved toward the operator.

An article to be sewn is moved by a cylindrical cap frame in the above-described multi-head sewing machine M. However, the invention may be applied to a sewing machine in which an article to be sewn is moved by a flat embroidery frame. Further, the invention may be applied to a sewing machine which is not provided with any embroidery frame and an article to be sewn is moved by a feed dog, by a feed roller or manually.

The free end side F of the thread loop L is located on the left of the needle 15 in the foregoing embodiment as shown in FIG. 11. Accordingly, the hook 62*b* of the thread drawing member 62 is open to the left side. However, the free end side of the thread loop may be located on the right of the needle so that the hook of the thread drawing member is open to the right side, instead.

The pulse motor is used as the drive motor 46 in the foregoing embodiment. Another type of motor, a solenoid or an air cylinder may be used as the drive motor, instead. Further, a recording medium on which the threading control program is recorded should not be limited to ROM. A flexible disc or a CD-ROM may serve as the recording medium. Additionally, the above-described multi-head sewing machine M includes the sewing bed 7 having a cylinder bed 8. However, the sewing bed may have a flat bed.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims

We claim:

1. A sewing machine comprising;

a threader including a threading hook for passing a thread through an eye of a needle;

a threader driver driving the threader so that the threading hook is advanced through or retreated through the eye of the needle;

a thread drawer including a thread drawing member wiping the thread extending through the needle eye downward, the thread drawing member also drawing a looped thread having been passed through the needle eye by the threading hook;

a thread drawer driver provided independent of the threader driver for moving the thread drawer so that the thread is wiped and a thread loop is released from a looped state; and a control unit controlling the threader driver and the thread drawer driver.

2. The sewing machine according to claim 1, wherein the control unit controls the threader driver so that the threading hook, after having been advanced through the needle eye, is retreated through the needle eye, whereupon a thread loop is formed by the thread having been passed through the needle eye, and the control unit controls the thread drawer driver so that the thread drawer is moved so that the thread is drawn to a position where the thread is released from a looped state.

3. The sewing machine according to claim 2, wherein a part of the thread between the needle and the threading hook is drawn by the thread drawing member while the threading hook in engagement with the thread is spaced away from the needle rearward.

4. The sewing machine according to claim 2, wherein the thread drawing member draws a free end side of the looped thread formed by the threading hook.

5. The sewing machine according to claim 2, wherein the control unit controls the thread drawer driver so that the thread drawer is moved to wipe the thread extending downward from the needle eye, and the thread drawing member has a shorter distance of movement in a case of releasing the thread from the looped state than a distance of movement in a case of wiping the thread.

6. The sewing machine according to claim 2, wherein the thread drawing member releases the thread from the looped state in a middle of a movement locus thereof in a case of wiping the thread.

7. The sewing machine according to claim 2, wherein the sewing machine is a multi-needle sewing machine including a plurality of needle bars provided with needles respectively.

* * * * *